US006277014B1

(12) United States Patent
Chen et al.

(10) Patent No.: US 6,277,014 B1
(45) Date of Patent: Aug. 21, 2001

(54) CARRIER HEAD WITH A FLEXIBLE MEMBRANE FOR CHEMICAL MECHANICAL POLISHING

(75) Inventors: Hung Chen, San Jose; Steven Zuniga, Soquel, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/169,500

(22) Filed: Oct. 9, 1998

(51) Int. Cl.[7] ..... B24B 5/00; B24B 47/02

(52) U.S. Cl. ..... 451/398; 451/287

(58) Field of Search ..... 451/41, 285, 286, 451/288, 289, 397, 398

(56) References Cited

U.S. PATENT DOCUMENTS

| | | | |
|---|---|---|---|
| 4,918,869 | 4/1990 | Kitta | 51/131.1 |
| 5,193,316 | 3/1993 | Olmstead | 51/281 |
| 5,205,082 | 4/1993 | Shendon et al. | 51/237 |
| 5,423,716 | 6/1995 | Strasbaugh | 451/388 |
| 5,449,316 | 9/1995 | Strasbaugh | 451/289 |
| 5,584,751 | 12/1996 | Kobayashi et al. | 451/288 |
| 5,624,299 | 4/1997 | Shendon | 451/28 |
| 5,643,053 | 7/1997 | Shendon | 451/28 |
| 5,643,061 | 7/1997 | Jackson et al. | 451/289 |
| 5,759,918 | 6/1998 | Hoshizaki et al. | 438/692 |
| 5,803,799 | 9/1998 | Volodarsky et al. | 451/288 |
| 5,851,140 | 12/1998 | Barns et al. | 451/288 |
| 5,879,220 | 3/1999 | Hasegawa et al. | 451/288 |
| 5,957,751 | 9/1999 | Govzman et al. | 451/8 |
| 5,964,653 | * 10/1999 | Perlov et al. | 451/285 |

FOREIGN PATENT DOCUMENTS

| | | |
|---|---|---|
| 0 841 123 A1 | 5/1998 | (EP) . |
| 0 859 399 A2 | 8/1998 | (EP) . |
| 2243263 | 9/1990 | (JP) . |
| WO 99/02304 | 1/1999 | (WO) . |
| WO 99/07516 | 2/1999 | (WO) . |

* cited by examiner

*Primary Examiner*—Derris H. Banks
(74) *Attorney, Agent, or Firm*—Fish & Richardson

(57) ABSTRACT

A carrier head for a chemical mechanical polishing apparatus has a base, a flexible membrane extending beneath the base to define a pressurizable chamber, a support structure positioned in the chamber, and a spacer ring positioned outside the chamber. The flexible membrane includes a lower surface of the flexible membrane provides a mounting surface for a substrate, and a perimeter portion that extends in a serpentine path between the spacer ring the support structure.

14 Claims, 6 Drawing Sheets

CARRIER HEAD WITH A FLEXIBLE MEMBRANE FOR CHEMICAL MECHANICAL POLISHING

BACKGROUND

The present invention relates generally to chemical mechanical polishing of substrates, and more particularly to a carrier head with a flexible membrane for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is the so-called "edge-effect," i.e., the tendency of the substrate edge to be polished at a different rate than the substrate center. The edge effect typically results in overpolishing (the removal of too much material from the substrate) at the substrate perimeter, e.g., the outermost five to ten millimeters of a 200 millimeter (mm) wafer.

Another problem, particularly in a carrier head with a flexible membrane, relates to the attachment of the flexible membrane to the carrier head. Typically, the flexible membrane is secured to the carrier head with a clamping ring. Unfortunately, there are a variety of potential problems with this arrangement, such as difficulty in securing the clamping ring, difficulty in ensuring that the seal between the flexible membrane and carrier head is fluid-tight, and danger that the flexible membrane will be torn or damaged.

SUMMARY

In one aspect, the invention is directed to a carrier head for a chemical mechanical polishing apparatus. The carrier head has a base, a flexible membrane extending beneath the base to define a pressurizable chamber, a support structure positioned in the chamber, and a spacer ring positioned outside the chamber. A lower surface of the flexible membrane provides a mounting surface for a substrate. The flexible membrane includes a perimeter portion that extends between a lower surface of the spacer ring and an upper surface of the support structure and around an inner surface of the spacer ring.

Implementations of the invention may include one or more of the following features. A retaining ring may surround the spacer ring to maintain the substrate beneath the mounting surface. A rim portion of the flexible membrane may be clamped between the retaining ring and the base. The spacer ring may include a flange portion that extends outwardly toward an inner surface of the retaining ring. The support structure may be a free-floating body. A ledge portion is formed in the base, and the support structure may include a rim portion that extends over the ledge portion to act as a stop to limit the downward motion of the support structure. The support structure may include a generally disk-shaped portion with a plurality of apertures therethrough, and a generally annular flange portion extending upwardly. The flexible membrane may extend between the inner surface of the spacer ring and the outer surface of the flange. The perimeter portion of the flexible membrane may extend above an upper surface of the spacer ring. The surface area of the lower surface of the spacer ring may be greater than the surface area of the upper surface of the spacer ring. The surface area of the upper surface of the spacer ring may be selected to adjust the pressure applied to an edge of a substrate. The perimeter portion of the flexible membrane may extend from the mounting surface upwardly around a first outer surface of the support structure, inwardly between a lower surface of the spacer ring and an upper surface of the support structure, upwardly around an inner surface of the spacer ring, and outwardly above an upper surface of the spacer ring. The perimeter portion may also extend between an inner surface of the spacer ring and a second outer surface of the support structure, and extend above an upper surface of the spacer ring to be attached to the base.

In another aspect, the invention is directed to a flexible membrane for a chemical mechanical polishing head. The flexible membrane has a central portion for contacting a substrate, and a perimeter portion that is molded in a serpentine path that extends from the mounting surface upwardly, inwardly, upwardly and outwardly.

Implementations of the invention may include the following. The flexible membrane may have a rim portion having a thickness greater than the perimeter portion.

Advantages of the invention may include the following. The flexible membrane may be secured to the carrier head in a quick, repeatable and reliable manner with little danger of damage. The single-piece flexible membrane reduces the number of parts in the carrier head and provides a reliable fluid-tight seal. Non-uniform polishing of the substrate is reduced, and the resulting flatness and finish of the substrate are improved.

Other advantages and features of the invention will be apparent from the following description, including the drawings and claims.

BRIEF DESCRIPTION OF THE DRAWING

Like reference numbers are designated in the various drawings to indicate like elements. A primed reference number indicates that an element has a modified function, operation or structure.

DETAILED DESCRIPTION

Figure 1:
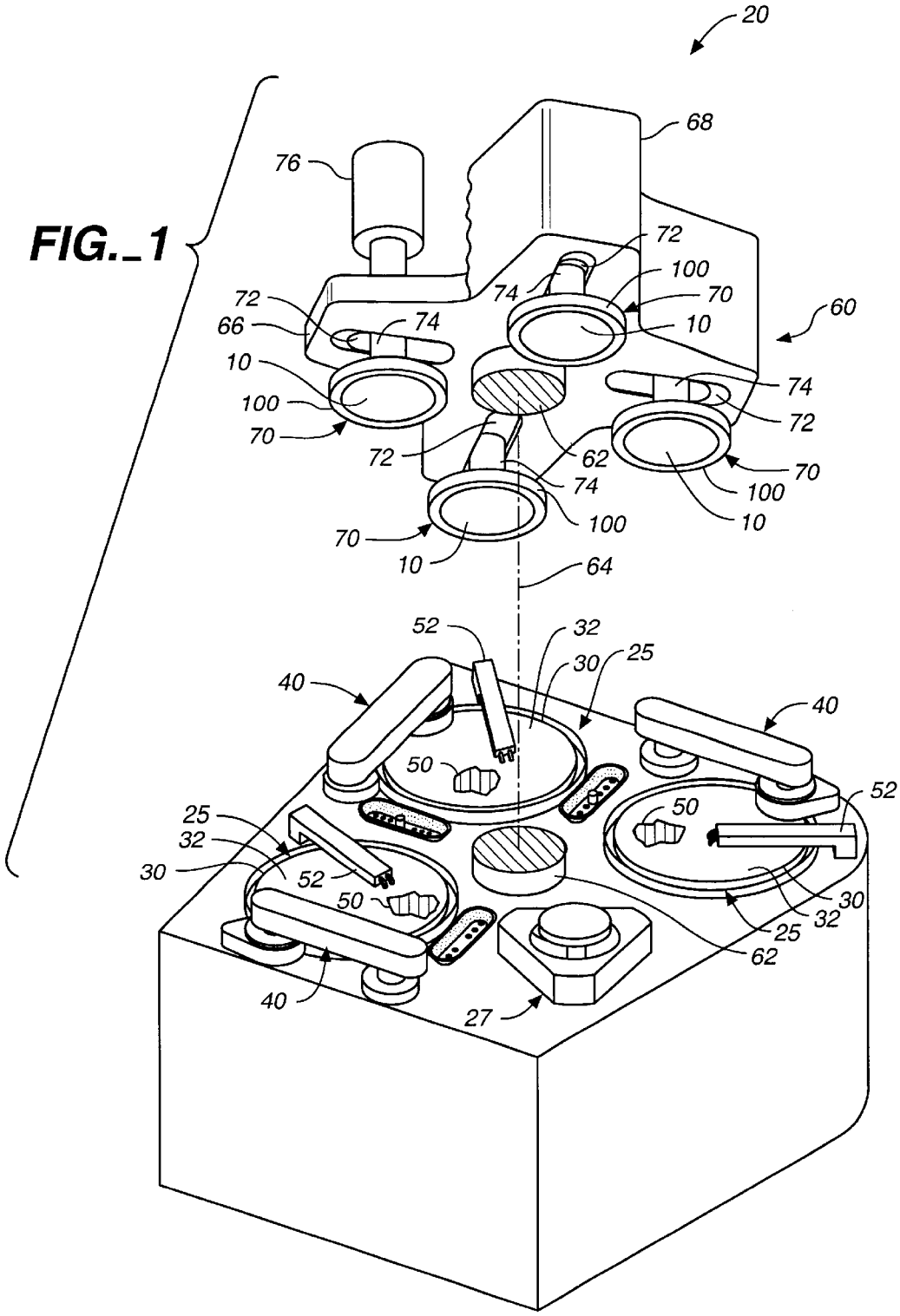
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference The CMP apparatus 20 includes a series of polishing stations 25 and a transfer station 27 for loading and unloading the substrates. Each polishing station 25 includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
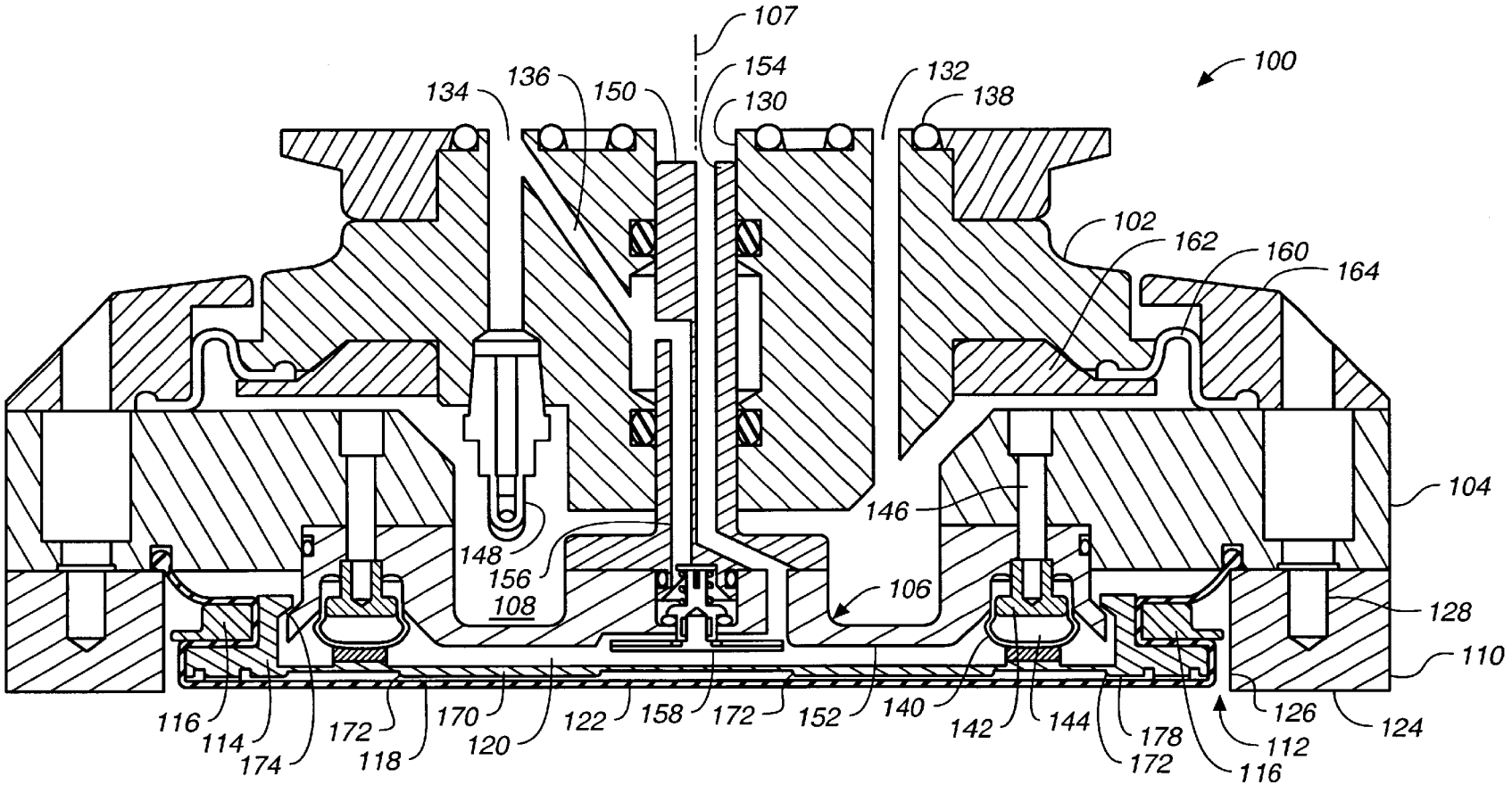
FIG. 2 is a schematic cross-sectional view of a carrier head according to the present invention.
Figure 3:
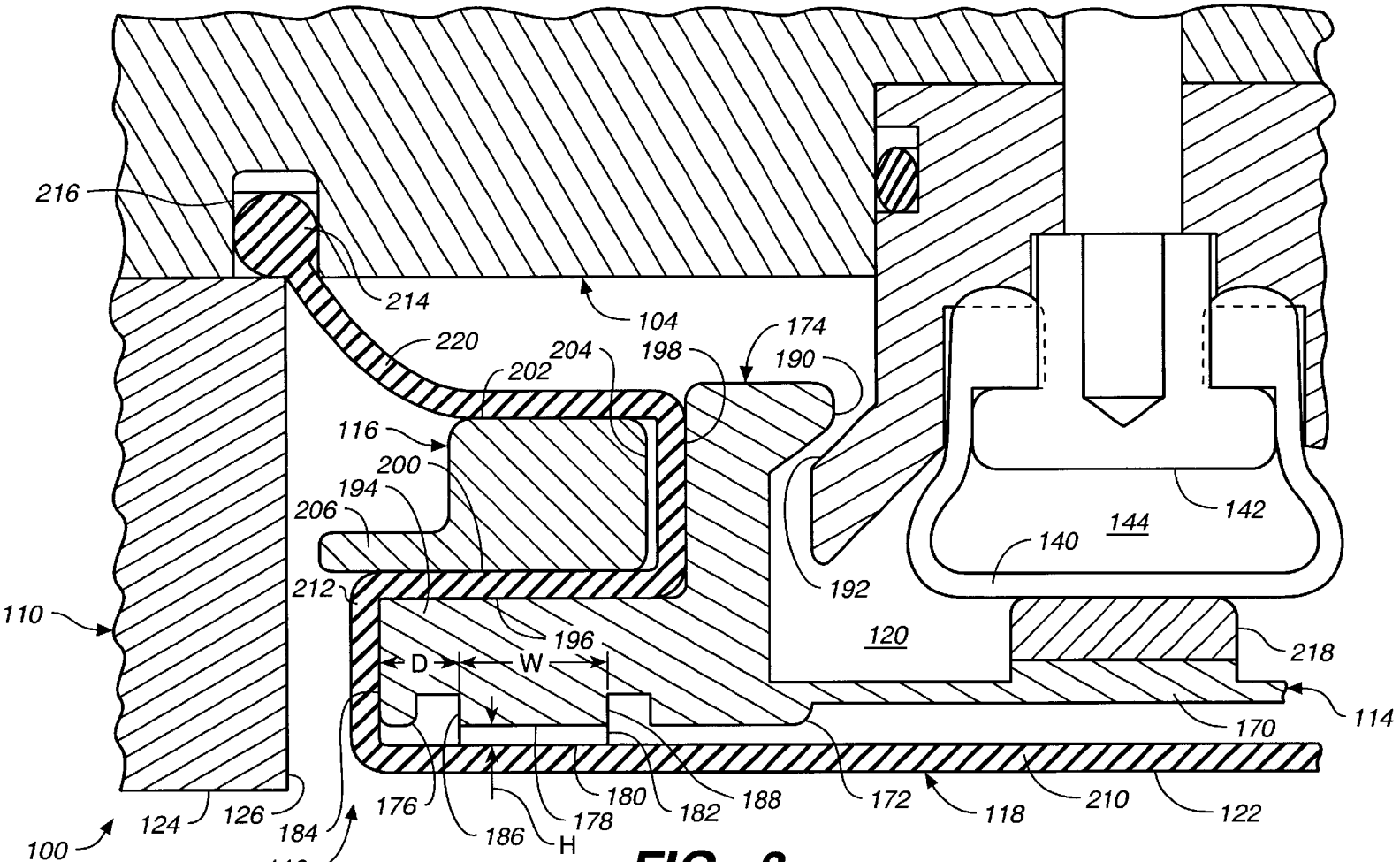
FIG. 3 is an enlarged view of the carrier head of FIG. 2 showing a flexible membrane and a spacer ring.
Figure 4:
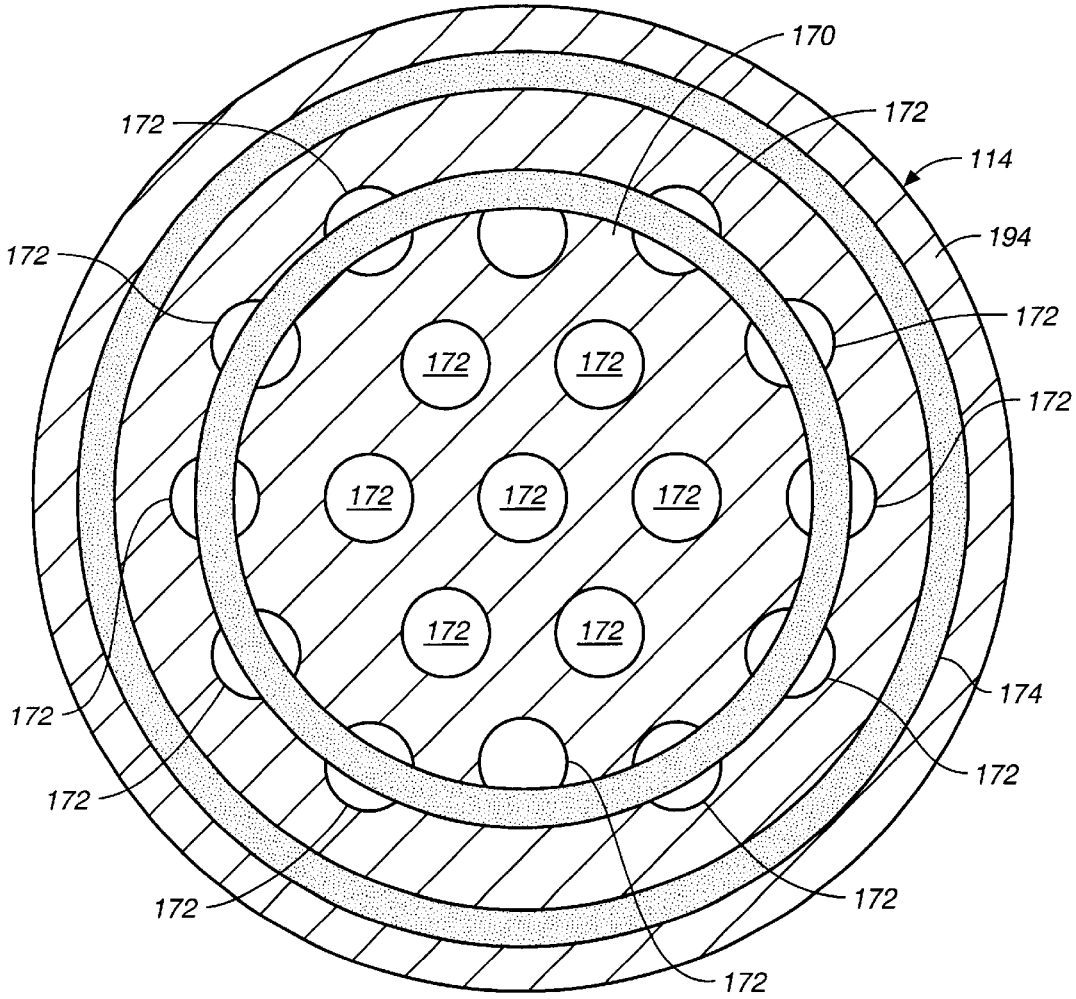
FIG. 4 is a plan view of a support structure from the carrier head of FIG. 2.
Figure 5A:
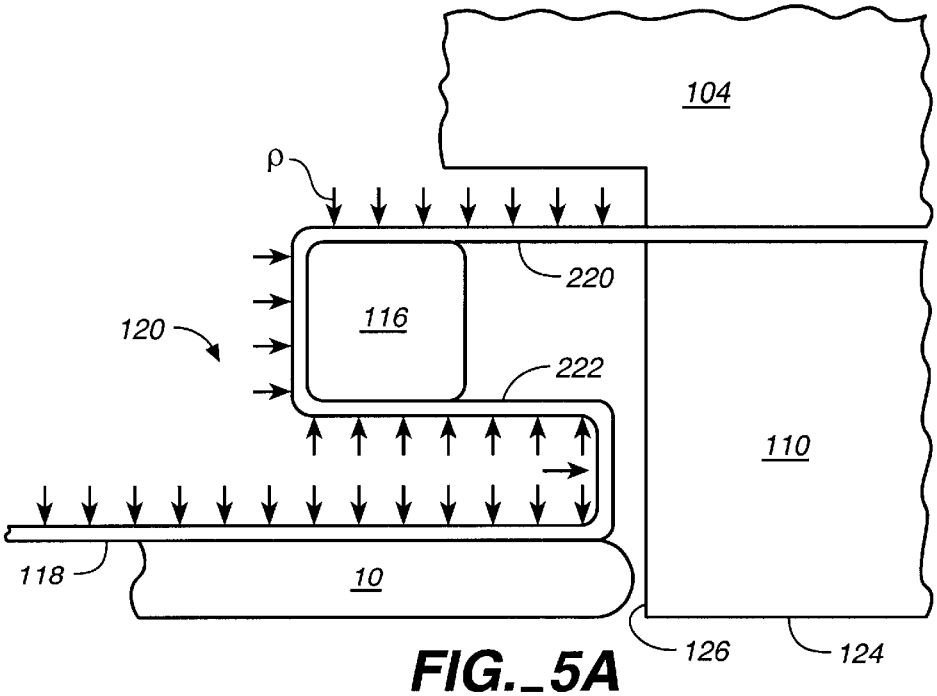
FIGS. 5A and 5B are schematic cross-sectional views illustrating pressure and force distributions on the flexible membrane.
Figure 5B:
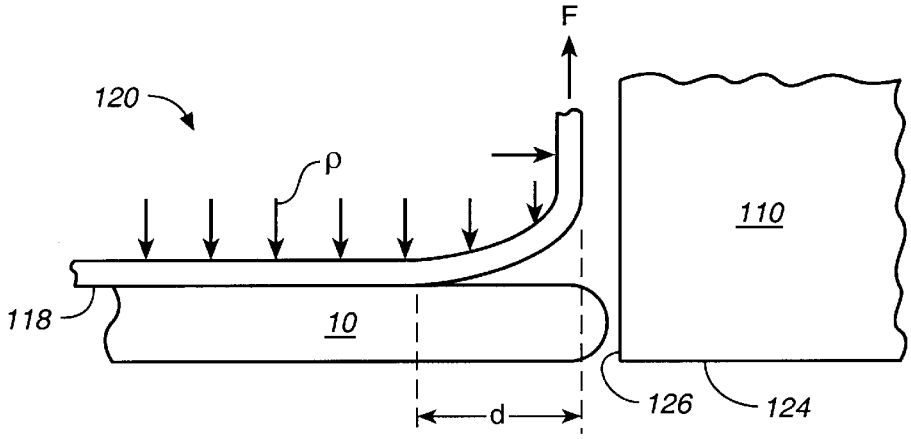

Referring to FIGS. 2–4, carrier head 100 includes a housing 102, a base 104, a gimbal mechanism 106, a loading chamber 108, a retaining ring 110, and a substrate backing assembly 112. A description of a similar carrier had may be found in U.S. application Ser. No. 08/745,679 by Zuniga, et al., filed Nov. 8, 1996, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and two passages 132 and 134 may extend through the housing for pneumatic control of the carrier head. In addition, a passage 136 may connect passage 134 to vertical bore 130. O-rings 138 may be used to form fluid-tight seals between the passages through the housing and passages through the drive shaft.

Base 104 is a generally rigid ring-shaped or disk-shaped body located beneath housing 102. An elastic and flexible membrane 140 may be attached to the lower surface of base 104 by a clamp ring 142 to define a bladder 144. Clamp ring 142 may be secured to base 104 by screws or bolts 146. A passage (not shown) may extend through the clamp ring and the base, and two fixtures 148 (only the fixture attached to housing 102 is shown) may provide attachment points to connect a flexible tube between housing 102 and base 104 to fluidly couple passage 134 to bladder 144. A first pump (not shown) may be connected to bladder 144 to direct a fluid, e.g., a gas, such as air, into or out of the bladder.

Loading chamber 108 is located between housing 102 and base 104 to apply a load, i.e., a downward pressure, to base 104. The vertical position of base 104 relative to polishing pad 32 is also controlled by loading chamber 108.

Gimbal mechanism 106, which may be considered to be part of base 104, permits the base to pivot with respect to housing 102 so that the base may remain substantially parallel with the surface of the polishing pad. Gimbal mechanism 106 includes a gimbal rod 150 which fits into vertical bore 130 and a flexure ring 152 which is secured to base 104. Gimbal rod 150 may slide vertically along bore 130 to provide vertical motion of base 104, but it prevents any lateral motion of base 104 with respect to housing 102. Gimbal rod 150 may include a first passage 154 that extends the length of the gimbal rod, and a second passage 156 that connects first passage 136 to an actuatable valve 158. Actuatable valve 158 may be used to sense the presence of a substrate, as described in U.S. application Ser. No. 08/862,350, by Boris Govzman et al., filed May 23, 1997, entitled A CARRIER HEAD WITH A SUBSTRATE DETECTION SYSTEM FOR A CHEMICAL MECHANICAL POLISHING SYSTEM, and assigned to the assignee of the present invention, the entire disclosure of which is incorporated herein by reference.

An inner edge of a generally ring-shaped rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. A second pump (not shown) may be fluidly connected to loading chamber 108 by passage 132 to control the pressure in the loading chamber and the load applied to base 104.

Retaining ring 110 may be a generally annular ring secured at the outer edge of base 104, e.g., by bolts 128. When fluid is pumped into loading chamber 108 and base 104 is pushed downwardly, retaining ring 110 is also pushed downwardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Substrate backing assembly 112 includes a support structure 114, a flexible member or membrane 118, and a spacer ring 116. A central portion 210 of flexible membrane 118 extends below support structure 114 to provide a mounting surface 122 to engage the substrate. A perimeter portion 212 of the flexible membrane extends in a serpentine path between support structure 114 and spacer ring 116 to be secured to the carrier head, e.g., to base 104 or retaining ring 110. The sealed volume between flexible membrane 118 and base 104 defines a pressurizable chamber 120. A third pump (not shown) may be fluidly connected to chamber 120 by passage 154 to control the pressure in chamber 120 and thus the downward force of the mounting surface on the substrate. In addition, chamber 120 may be evacuated to pull flexible membrane 118 upwardly and thereby vacuum-chuck the substrate to the carrier head.

Support structure 114 is located inside chamber 120 to provide a rigid support for the substrate during substrate chucking, to limit the upward motion of the substrate and flexible membrane when chamber 120 is evacuated, and to maintain the desired shape of flexible membrane 118. Specifically, support structure 114 may be a generally rigid member having a disk-shaped plate portion 170 with a plurality of apertures 172 formed therethrough, and a generally annular flange portion 174 that extends upwardly from plate portion 170. In addition, plate portion 170 may have a downwardly-projecting lip 176 at its outer edge. Support structure 114 may be "free-floating", i.e., not secured to the rest of the carrier head, and may be held in place by the flexible membrane.

Referring to FIG. 3, an optional annular projection 180 may extend downwardly from plate portion 170. The projection 180 may be formed by adhesively attaching a layer of compressible material 182 to a lower surface 178 of the plate portion. Annular projection 180 has a width W, a height H, and is located a distance D from an outer surface 184 of support structure 114. Two annular recesses or grooves 186 and 188 may be formed in lower surface 178 surrounding projection 180. The two grooves 86 and 188 may be used for aligning or trimming the layer of compressible material to ensure that it corresponds to the desired dimensions of the projection. Bladder 144 may be used to apply a downward force to support structure 114 so that projection 180 directly contacts a top surface of the flexible membrane to preferentially apply pressure to selected areas of the substrate, as discussed in U.S. application Ser. No. 08/907,810, by Steven M. Zuniga, et al., filed Aug. 8, 1997, entitled A CARRIER HEAD WITH LOCAL PRESSURE CONTROL FOR A CHEMICAL MECHANICAL POLISHING APPARATUS, and assigned to the assignee of the present invention, the entire disclosure of which is incorporated herein by reference. By appropriately selecting the dimensions W, H and D, an area of increased pressure on the substrate may be provided to optimize polishing performance. The layer of compressible material provides a region of soft contact to prevent damage to the substrate.

Flange portion 174 of support structure 114 includes a rim 190 that extends over a ledge 192 formed in base 104. When polishing is complete and loading chamber 108 is evacuated to lift base 104 away from the polishing pad, and chamber 120 is either pressurized or vented, the lower surface of rim 190 engages ledge 192 to act as a hard stop that limits the downward motion of support structure 114 and prevents overextension of the flexible membrane.

Spacer ring 116 is a generally annular member positioned between retaining ring 110 and support structure 114. Specifically, spacer ring 116 may be located above a perimeter portion 194 of support structure 114 that extends radially outward beyond flange portion 174. Spacer ring 116 includes a substantially flat lower surface 200, a substantially flat upper surface 202, and a substantially cylindrical inner surface 204. Spacer ring 116 also includes a flange portion 206 which extends outwardly toward inner surface 126 of retaining ring 110 to maintain the lateral position of the spacer ring.

Flexible membrane 118 is a generally circular sheet formed of a flexible and elastic material, such as chloroprene or ethylene propylene rubber, or silicone. As noted, central portion 210 of the flexible membrane defines mounting surface 122, whereas perimeter portion 212 extends in a serpentine fashion between support structure 114 and spacer ring 116 to be clamped between base 104 and retaining ring 110. Specifically, perimeter portion 212 extends upwardly around outer surface 184 of support structure 114, inwardly between lower surface 200 of spacer ring 116 and an upper surface 196 of perimeter portion 194, upwardly between inner surface 204 of spacer ring 116 and an outer surface 198 of flange portion 174, and then outwardly along upper surface 202 of spacer ring 116. The flexible membrane 118 may terminate in a thick rim portion 214 which fits into an annular recess 216 in base 104. When retaining ring 110 is secured to base 104, rim portion 214 is clamped between base 104 and retaining ring 110 to form a fluid-tight seal. A "free span" portion 220 of the flexible membrane extends between rim portion 214 and the outer diameter of the upper surface of spacer ring 216. The flexible membrane may be pre-molded into a serpentine shape.

In operation, fluid is pumped into chamber 120 to control the downward pressure applied to the substrate by flexible membrane 118. When polishing is finished, chamber 108 is evacuated to lift base 104 and support structure 114 away from the polishing pad. In addition, since spacer ring 116 rests on support structure 114, it will also be lifted away from the polishing pad. As discussed, if chamber 120 is pressurized or vented while base 104 has been lifted away from the polishing pad, ledge 192 engages rim 190 to limit the downward motion of support structure 114 and spacer ring 116 and prevent overextension of the flexible membrane.

A generally annular projection 218 may extend upwardly from plate portion 170 of support structure 114. When bladder 144 is inflated, it contacts projection 218 to exert a downward pressure on support structure 114. Bladder 144 can be used to press projection 180 against the top surface of the flexible membrane to locally increase the pressure on the substrate and compensate for non-uniform polishing. Bladder 144 is also used to press the flexible membrane 118 against substrate 10, thereby creating a fluid tight seal to ensure vacuum-chucking of the substrate to the flexible membrane when chamber 120 is evacuated. Alternately, if support structure 114 does not include a projection, bladder 144 may be used to cause lip 176 of plate portion 170 to press the edge of flexible membrane 118 against substrate 10 to creating a fluid-tight seal for vacuum-chucking.

As previously discussed, one reoccurring problem in CMP is non-uniform polishing near the edge of the substrate. However, spacer ring 116 may be used to control the pressure distribution applied by flexible membrane 118 near the substrate edge. Referring to FIGS. SA and 5B (for simplicity, only elements involved in determining the pressure at the substrate edge are illustrated), the pressure in chamber 120 tends to urge the portions of flexible membrane 118 on either side of spacer ring 116 toward each other. However, part of the downward force on "free span" portion 220 of flexible membrane 118 is reacted out by retaining ring 110, resulting in a net upward tensile force F in the membrane. This net upward force tends to lift corner 228 of flexible membrane away from the substrate. This force F is proportional to the area of "free-span" portion 220. In equilibrium, the force F will satisfy the equation $F=P\times A$, where P is the pressure in chamber 120 and A is the area of the flexible membrane that lifts off the substrate. The area A may be calculated from $A=\pi(2Rd-d^2)$, where R is the radius of the substrate or the perimeter portion of the flexible membrane, and d is the width of the portion of the flexible membrane that lifts away from the substrate. By appropriately selecting the ratio of the surface area of upper surface 202 to the surface area of lower surface 200 of spacer ring 116, the relative pressure applied at the corner of flexible membrane 118 to the substrate perimeter may be adjusted to reduce non-uniform polishing. By increasing the surface area of upper surface 202, the "free-span" area of the flexible membrane is reduced, thereby reducing the area of the flexible membrane that lifts off the substrate and increasing the effective pressure on the substrate edge. Conversely, by decreasing the surface area of upper surface 202, the pressure on the substrate edge will be effectively decreased. The optimal surface area of upper surface 202 of spacer ring 116 to minimize the edge effect may be determined experimentally.

Figure 6:
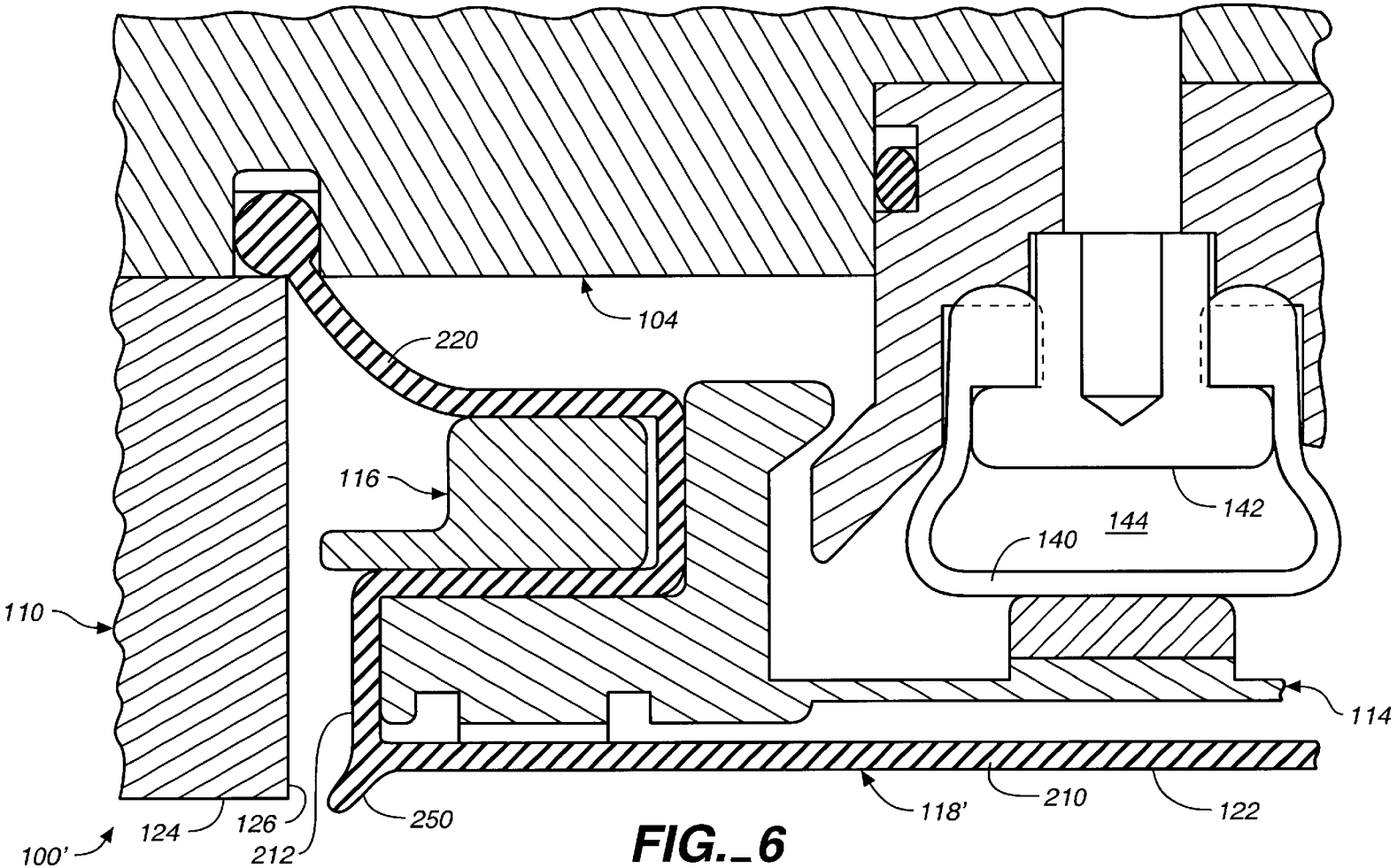
FIG. 6 is a cross-sectional view of a carrier head having a flexible membrane with a lip.

Referring to FIG. 6, carrier head 100'may include a flexible membrane 118'having an annular lip 250. When chamber 120 is evacuated, lip 250 may be pulled against substrate 10 to form a seal and improve the vacuum-chucking of the substrate, as described in U.S. patent application Ser. No. 09/149,806 by Zuniga, et al., filed Aug. 31, 1998, entitled A CARRIER HEAD FOR CHEMICAL MECHANICAL POLISHING, and assigned to the assignee of the present invention, the entire disclosure of which is incorporated herein by reference.

The present invention has been described in terms of a number of embodiments. The invention, however, is not limited to the embodiments depicted and described. Rather, the scope of the invention is defined by the appended claims.

What is claimed is:

1. A carrier head for a chemical mechanical polishing apparatus, comprising:

a base;

a flexible membrane extending beneath the base to define a pressurizable chamber, a lower surface of the flexible membrane providing a mounting surface for a substrate;

a support structure positioned in the chamber; and a spacer ring positioned outside the chamber, wherein the flexible membrane includes a perimeter portion that extends between a lower surface of the spacer ring and an upper surface of the support structure and around an inner surface of the spacer ring.

2. The carrier head of claim 1, further comprising a retaining ring surrounding the spacer ring to maintain the substrate beneath the mounting surface.

3. The carrier head of claim 2, wherein a rim portion of the flexible membrane is clamped between the retaining ring and the base.

4. The carrier head of claim 1, wherein the spacer ring includes a flange portion that extends outwardly toward an inner surface of the retaining ring.

5. The carrier head of claim 1, wherein the support structure is a free-floating body.

6. The carrier head of claim 5, wherein a ledge portion is formed in the base, and the support structure includes a rim portion that extends over the ledge portion to act as a stop to limit the downward motion of the support structure.

7. The carrier head of claim 1, wherein the support structure includes a generally disk-shaped portion with a plurality of apertures formed therethrough.

8. The carrier head of claim 1, wherein the support structure includes a generally annular flange portion extending upwardly, and the flexible membrane extends between the inner surface of the spacer ring and the outer surface of the flange portion.

9. The carrier head of claim 1, wherein the perimeter portion of the flexible membrane extends above an upper surface of the spacer ring.

10. The carrier head of claim 9, wherein the surface area of the lower surface of the spacer ring is greater than the surface area of the upper surface of the spacer ring.

11. The carrier head of claim 9, wherein a first surface area of the spacer ring is selected to adjust the pressure applied to an edge of a substrate.

12. The carrier head of claim 9, wherein the perimeter portion of the flexible membrane extends from the mounting surface upwardly around a first outer surface of the support structure, inwardly between a lower surface of the spacer ring and an upper surface of the support structure, upwardly around an inner surface of the spacer ring, and outwardly above an upper surface of the spacer ring.

13. The carrier head of claim 9, wherein the perimeter portion of the flexible membrane extends from the mounting surface upwardly around a first outer surface of the support structure, inwardly between a lower surface of the spacer ring and an upper surface of the support structure, upwardly between an inner surface of the spacer ring and a second outer surface of the support structure, and outwardly above an upper surface of the spacer ring to be attached to the base.

14. A flexible membrane for a chemical mechanical polishing head, comprising:

a central portion to contact a substrate;

a perimeter portion that is molded in a serpentine path that extends from the central portion upwardly inwardly upwardly and outwardly; and a rim portion having a thickness greater than the perimeter portion.

* * * * *